US008132811B2

(12) United States Patent
Bryl

(10) Patent No.: US 8,132,811 B2
(45) Date of Patent: Mar. 13, 2012

(54) DRIVE NIP RELEASE APPARATUS

(75) Inventor: Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 340 days.

(21) Appl. No.: 12/174,950

(22) Filed: Jul. 17, 2008

(65) Prior Publication Data

US 2010/0013150 A1 Jan. 21, 2010

(51) Int. Cl.
*B65H 5/02* (2006.01)

(52) U.S. Cl. ..... 271/273; 271/274

(58) Field of Classification Search ..... 271/273, 271/274, 118; 74/54, 567, 569, 55, 53
See application file for complete search history.

(56) References Cited

U.S. PATENT DOCUMENTS

| | | | | |
|---|---|---|---|---|
| 4,411,209 | A | 10/1983 | Szostak et al. | |
| 4,854,236 | A * | 8/1989 | Thunker et al. | 101/411 |
| 5,024,432 | A * | 6/1991 | Thunker et al. | 271/268 |
| 5,398,607 | A * | 3/1995 | Fricke et al. | 101/409 |
| 5,456,128 | A * | 10/1995 | Thunker | 74/53 |
| 6,073,503 | A * | 6/2000 | Matsuno et al. | 74/55 |
| 6,168,153 | B1 | 1/2001 | Richards et al. | |
| 6,173,952 | B1 | 1/2001 | Richards et al. | |
| 6,364,275 | B1 * | 4/2002 | Lindsay | 248/648 |
| 6,837,491 | B2 * | 1/2005 | Becker et al. | 271/204 |
| 6,990,898 | B2 * | 1/2006 | Kato | 100/282 |
| 7,111,362 | B2 | 9/2006 | Gordecki | |
| 2001/0004886 | A1 * | 6/2001 | Brothers | 123/90.48 |
| 2007/0018387 | A1 * | 1/2007 | Yamamoto | 271/272 |

* cited by examiner

*Primary Examiner* — Jeremy R Severson
(74) *Attorney, Agent, or Firm* — Gibb I.P. Law Firm, LLC

(57) ABSTRACT

An energy storage apparatus has one or more camshafts, one or more cams connected to the camshaft, one or more followers contacting the cam, one or more biasing members connected to the follower, and one or more tracks connected to the follower. With embodiments herein the track limits movement of the follower to a constrained path intersecting the axis about which the camshaft rotates. Alternatively, the biasing member itself can limit the movement of the follower to this linear path. The biasing member can comprise any force member such as a spring, a piston, a flexible member, a compressible member, etc. that has the ability to bias the follower toward the axis of the camshaft. The embodiments herein store and transfer potential energy to reduce the total reflected torque on the motor.

16 Claims, 6 Drawing Sheets

DRIVE NIP RELEASE APPARATUS

BACKGROUND AND SUMMARY

Embodiments herein generally relate to a printing apparatus (e.g., electrostatographic and/or xerographic machine and/or process) and more particularly relate to an energy storage device that is useful within drive nips, such as the drive nips of a printing apparatus.

In drive nips, opposing rollers are biased against one another. The details of drives nips are only briefly touched upon in this disclosure; however, an extensive discussion of such structures can be found in U.S. Pat. Nos. 6,173,952; and 6,168,153, the complete disclosures of which are incorporated herein by reference. Briefly, the drive nips comprise drive rollers and corresponding idler rollers opposite the drive rollers. The drive roller is driven by a motor and the idler roller is biased against the drive roller and freely rotates with the drive roller to cause a piece of media (paper, transparencies, cardstock, etc.) to be moved through the drive nip. A drive axle is operatively connected to the drive rollers. The drive axle rotates in a forward direction when moving media through the media drive nip.

In addition, one or more cams are operatively connected to corresponding idler rollers by way of cam followers. The cam followers transfer movement of the cams to the idler rollers. As the cams rotate, the cams move the idler rollers between a first position biased against the drive rollers and a second position out of contact with the drive rollers. The cams can be shaped and positioned to move pairs of the idler rollers differently as the cams rotate to accommodate different media widths. Thus, for example, one set of cams could cause only the outer pair of idler rollers to be biased against their corresponding drive rollers for wide media, while another set of cams could cause just an inner pair of idler rollers to be biased against their corresponding drive rollers to accommodate a narrower piece of media. In addition, drive nips can be individually engaged to align the media.

Thus, the nip release assembly includes spring loaded idler rolls that are raised, or lowered, using a cam/follower mechanism driven by a stepper motor. In some situations, two of the idler rolls can be raised and lowered in pairs, while a third idler can remain in the raised position. The peak torque, reflected to the stepper motor, can occur as a pair of idler rolls is raised.

There is a delicate balance between speed/acceleration of actuation and the reflected torque on the stepper motor. While increased actuation speeds/accelerations require increased motor torque to overcome the inertial effects, scaling the motor up to handle larger torque loads is not always viable. Upgrading to a larger motor may be prohibitive because of cost, size, larger rotor inertia, etc. A common approach is to design and model a system where the motor is sized properly to operate with the reflected torque.

Embodiments herein address such issues with an energy storage device connected to the camshaft. Many devices could use such an apparatus, such as a printing apparatus that could have at least one media drive nip. More specifically, embodiments herein provide an energy storage apparatus used in a drive nip, a printing device that includes such an apparatus, a module installable in a printing device that uses such an apparatus, etc.

The energy storage apparatus has one or more camshafts, one or more cams connected to the camshaft, one or more followers contacting the cam, one or more biasing members connected to the follower, and one or more tracks or spring loaded followers on a pivot arm (idler arm using a torsion spring) connected to the follower. With embodiments herein the track can limit movement of the follower to a curved or linear constrained path intersecting the axis about which the camshaft rotates. Alternatively, the biasing member itself can limit the movement of the follower to this linear path. The biasing member can comprise any force member such as a spring, a piston, a flexible member, a compressible member, etc. that has the ability to bias the roller toward the axis of the camshaft.

The apparatus can also include a stationary frame connected to the biasing member. More specifically, the biasing member has a first end connected to the follower and a second end connected to the frame (which could be the main frame). The biasing member stores potential energy as the follower moves away from the axis of the camshaft, and the biasing member releases stored potential energy as the follower moves toward the axis of the camshaft. As the biasing member releases the stored potential energy, it eases the load of the motor driving the camshaft, thereby decreasing peak torque requirements of the motor. The potential energy is transferred to the follower on the idler member. As one stores potential energy, the other releases potential energy, canceling each other.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, in stepper motor driven cam operated drive nip assemblies, there is a delicate balance between speed/acceleration of actuation and the reflected torque on the stepper motor. While increased actuation speeds/accelerations require increased motor torque to overcome the inertial effects, scaling the motor up to handle larger torque loads is not always viable. Upgrading to a larger motor may be prohibitive because of cost, size, larger rotor inertia, etc. A common approach is to design and model a system where the motor is sized properly to operate with the reflected torque. As shown in the graphs in FIG. 1, the reflected torque can be broken down into three primary loads: spring loads 100, inertial loads, and loads from accelerations 102, and friction loads 104 (each load curve being illustrated graphically). Each of these needs to be managed to keep loads within the limits of the motor.

Figure 1:
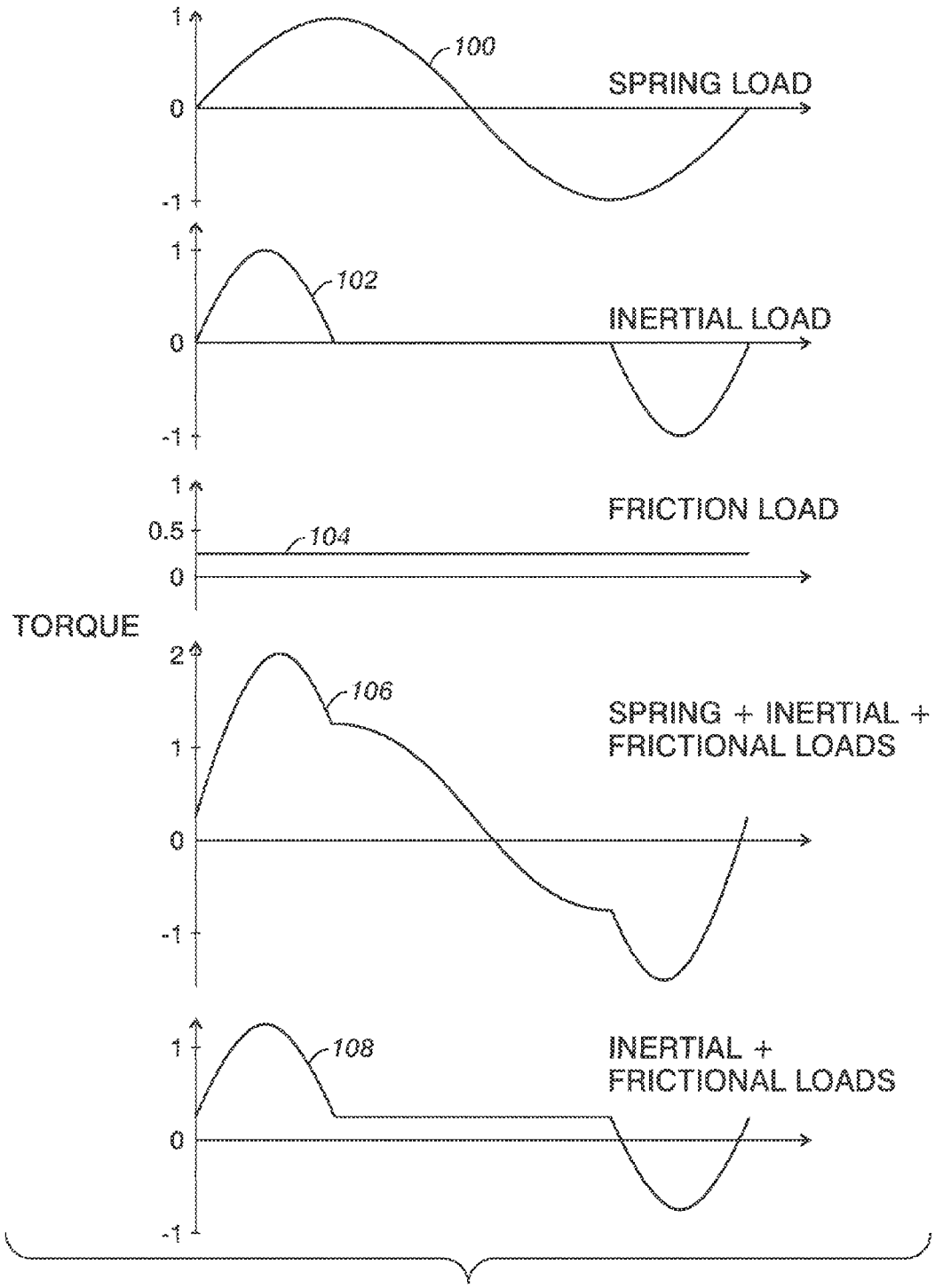
FIG. 1 illustrates a number of torque curves relating to loads reflected to the drive motor from a cam/follower mechanism.

The embodiments herein provide a way to reduce, if not eliminate, the spring loads. More specifically, the curve in graph 106 in FIG. 1 illustrates a combination of the spring load 100, the inertial load 102, and the frictional load 104. The embodiments herein reduce or eliminate the spring load resulting in loads that are essentially the inertial load 102 added to the frictional load 104 and such combined loads are shown as the curve in graph 108 in FIG. 1.

Embodiments herein address such issues with an energy storage device connected to the camshaft. Many devices could use such an apparatus, such as a printing apparatus that could have at least one media drive nip. More specifically, embodiments herein provide an energy storage apparatus used in a drive nip, a printing device that includes such an apparatus, a module installable in a printing device that uses such an apparatus, etc.

The embodiments herein provide conservation of energy in a stepper-motor driven cam assembly. Cams are commonly used to control movement of mechanisms with precise positioning and timing. In some situations, the cam actuates a spring loaded mechanism. While some different examples of the use of cams in drive nips are shown in FIGS. 2-5, below, as would be understood by those ordinarily skilled in the art, there can be infinite configurations of spring and cam-follower assemblies that this concept could be applied to, and the embodiments herein are not limited to the examples shown in the attached drawings.

Figure 2:
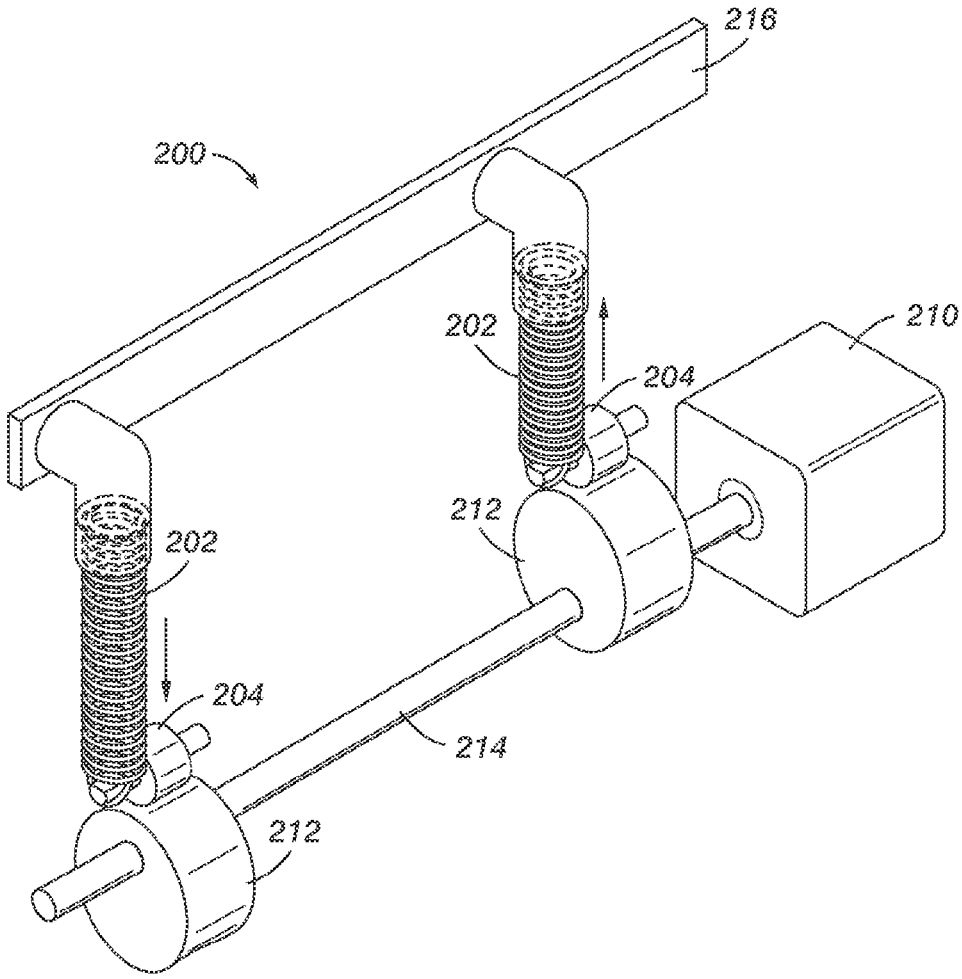
FIG. 2 is a schematic diagram illustrating a potential energy storage apparatus.

Referring now to one example structure that is used to illustrate the concepts of the invention, FIG. 2 illustrates an energy storage apparatus 200 connected to a camshaft 214. Many devices could use such an apparatus 200, such as a printing apparatus (FIG. 6, discussed below) that could have at least one media drive nip. More specifically, embodiments herein provide an energy storage apparatus (FIGS. 2-4) used in a drive nip, a printing device (FIG. 6) that includes such an apparatus, a module installable in a printing device that uses such an apparatus (FIG. 5), etc.

Figure 3:
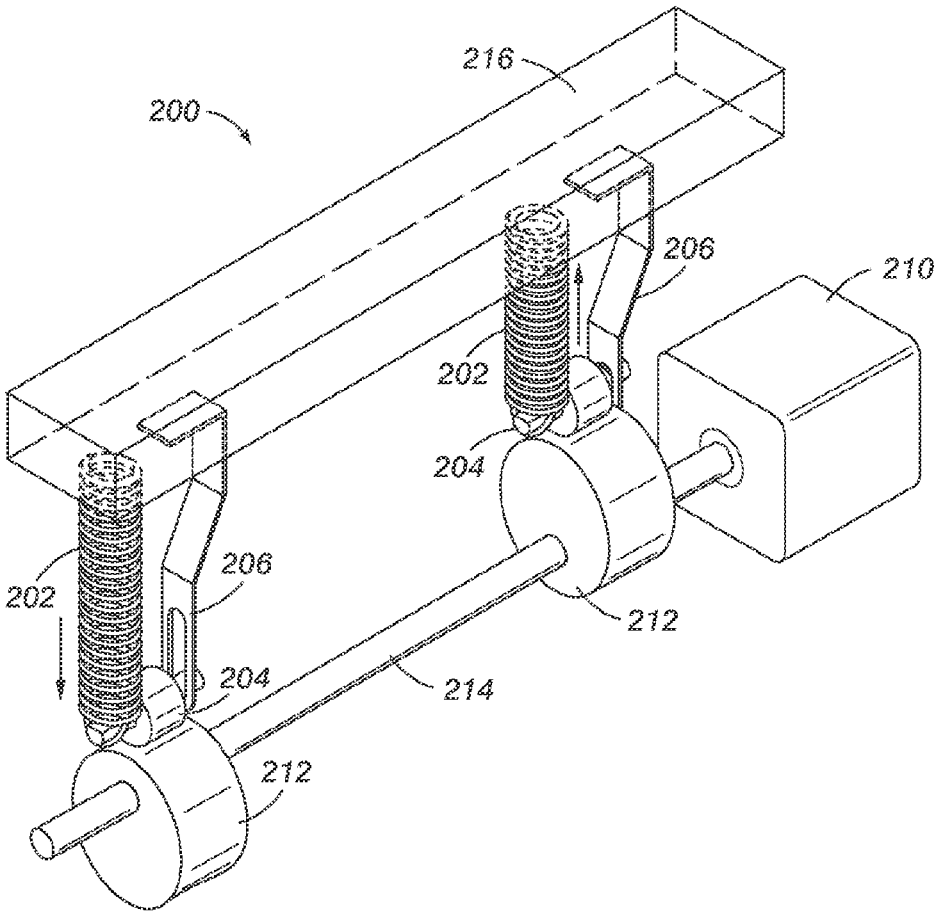
FIG. 3 is a schematic diagram illustrating a potential energy storage apparatus.

The potential energy storage apparatus 200 has one or more camshafts 214, one or more cams 212 connected to the camshaft 214, one or more followers 204 contacting the cam 212, and one or more biasing members 202 connected to the follower 204. As shown in FIG. 3, the structure can also include one or more tracks 206 connected to the axis of the follower 204.

With embodiments herein the biasing member 202, or the track 206 limits movement of the follower 204 to a linear path (constrained path) as indicated by the arrows in FIG. 2. Alternatively, the follower could follow an arc if a pivoting arm was used. While the follower 204 can always freely rotate, the non-rotational movement of the follower 204 itself with respect to the other elements is therefore limited to two degrees of freedom, one moving toward the axis of the camshaft 214 and one moving away from the axis of the camshaft 214 (or another point adjacent to the camshaft). Therefore, the motion of the follower 204 is orthogonal to the line made by the axis of the camshaft or it is orthogonal to a line that is parallel to the axis of the camshaft. Thus, in the embodiment shown in FIGS. 2-4, the linear path along which the follower 204 travels intersects the axis about which the camshaft 214 rotates.

Figure 4:
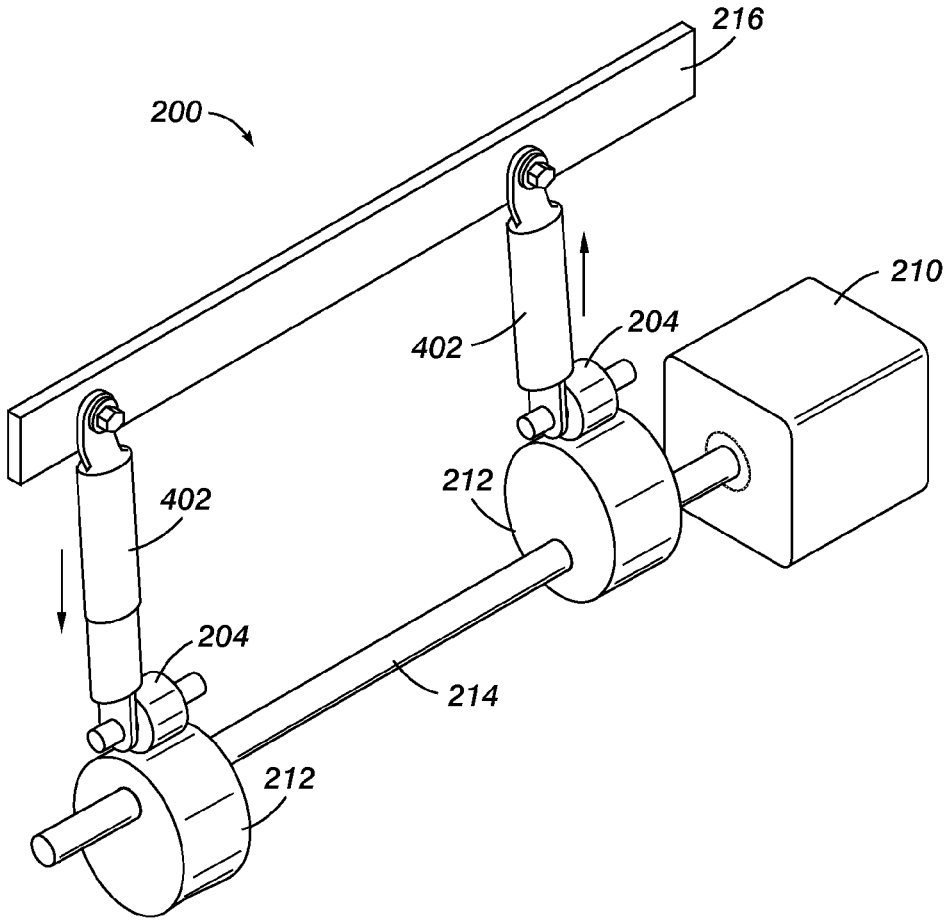
FIG. 4 is a schematic diagram illustrating a potential energy storage apparatus.

The biasing member 202 can comprise any force storing member such as a spring 202 (FIGS. 2-3); or as shown in FIG. 4 the biasing member 402 can comprise a piston a flexible member (e.g., rubber, plastic, polymer, etc.) a compressible member, etc. Thus, any item that has the ability to bias the follower 204 toward the axis of the camshaft 214 can be used as the biasing member 202, 402. Depending upon the rigidity of the biasing member 202, 402, the biasing member 202, 402 can limit the movement of the follower 204 to the linear path that intersects the axis of the camshaft 214, or the frame 206 can limit the movement of the follower 204 to such a path.

The apparatus can also include a stationary frame 216 that firmly supports one end of the biasing member 202 in a fixed position with respect to the axis of the camshaft 214. More specifically, the biasing member 202 has a first end connected to the follower 204 and a second end connected to the frame 216. The biasing member 202 compresses and stores potential energy as the follower 204 moves away from the axis of the camshaft 214, and the biasing member 202 expands and releases stored potential energy as the follower 204 moves toward the axis of the camshaft 214. As the biasing member 202 releases the stored potential energy, it eases the load of the motor driving the camshaft 214, thereby decreasing peak torque requirements of the motor.

As the cam 212 is rotated, energy from the drive system (e.g., motor, engine, etc.) is used to deflect the spring loaded mechanism 200. Potential energy is stored in the energy storage device 200, as potential energy as the biasing member 202, 402 is deflected. As the cam 212 continues to rotate back to the original position, the potential energy is released from the springs of the cam followers (idlers) providing a loading force to the energy storage apparatus 200. When turning the camshaft 214, the torque increases as the biasing member 202, 402 is deflected.

As the biasing member 202, 402 are loaded by rotating the camshaft 214 back to the original position; resistance torque is transferred from the camshaft 214 to the biasing member 202, 402. This potential energy is released back to the camshaft 214 when the camshaft moves from the original position. In conventional stepper-motor driven systems, this potential energy is not recovered because there is no means to store the potential energy released from the biasing members of the cam followers.

Figure 5:
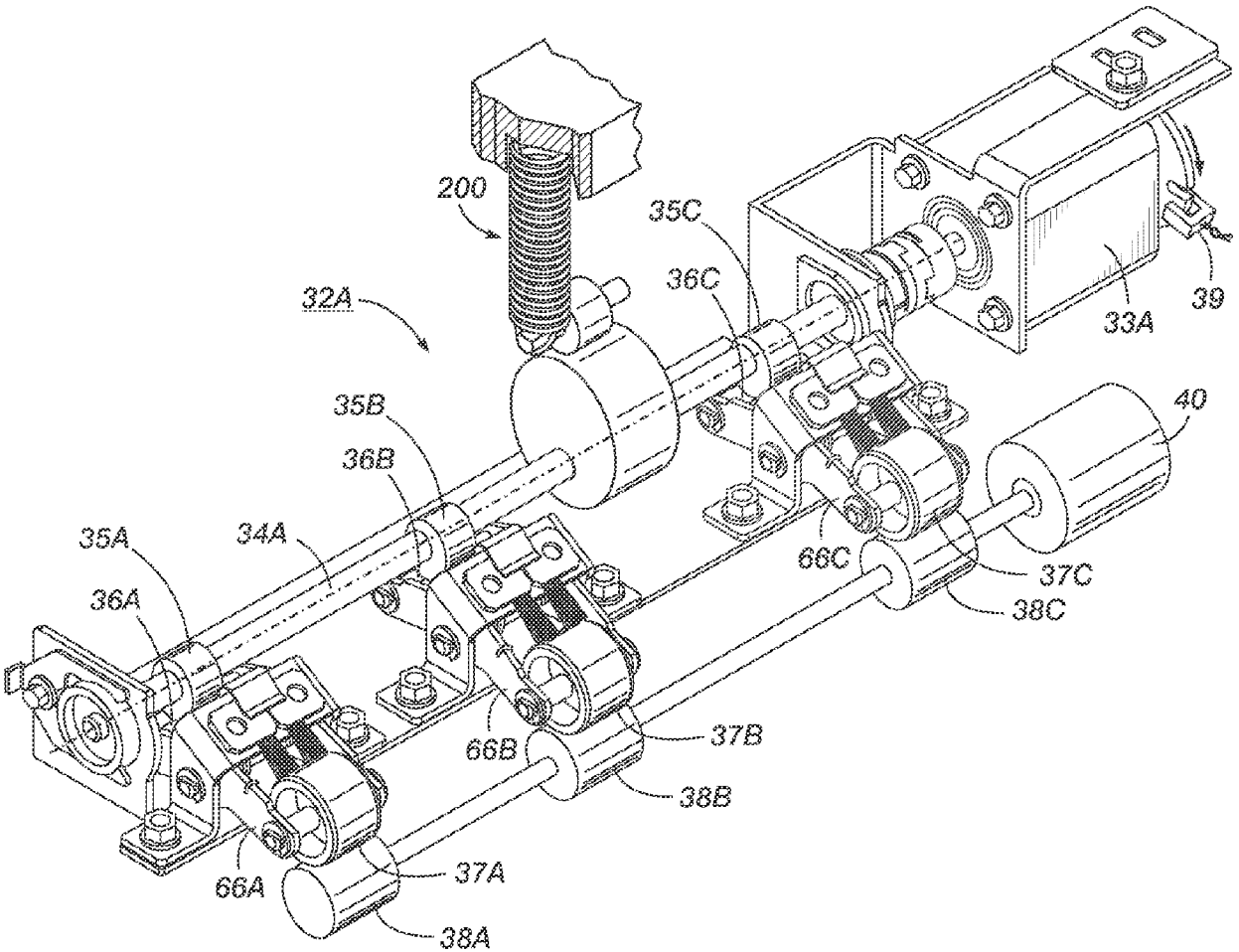
FIG. 5 is a schematic diagram illustrating a nip drive apparatus.

One example of the use of the potential energy storage apparatus 200 within a nip drive is shown in FIG. 5. Note that the structure shown in FIG. 5 is similar to the nip drive shown in U.S. Pat. No. 6,173,952 (mentioned above); however the structure shown in FIG. 5 includes the energy storage apparatus 200. The nip drive 32A shown in FIG. 5 includes a camshaft 34A that extends transversely across the paper path and has three laterally spaced identical cams 35A, 35B, 35C thereon, respectively positioned to act on three identical spring-loaded idler lifters 36A, 36B, 36C, respectively mounting idler wheels 37A, 37B, 37C mounted on idler lifters 66A, 66B, 66C, whenever the camshaft 34A is rotated by approximately 90-120 degrees by stepper motor 33A. The stepper motor 33A or its connecting shaft may have a conventional notched disk optical "home position" sensor 39 and may be conventionally rotated by the desired amount or angle to and from that "home position" by application of the desired number of step pulses by a controller 204. In the home position, all three cams lift and disengage all three of the respective identical idlers 37A, 37B, 37C above the paper path away from their normally nip-forming or mating sheet drive rollers 38A, 38B, 38C mounted and driven from below the paper path. All three of such paper path drive rollers 38A, 38B, 38C of all three of the units 32A, 32B, 32C may be commonly driven by a single common drive system 40, with a single drive motor.

In the "home position" of the cams, as noted, all three sheet feeding nips are open. That is, the idler wheels 37A, 37B, 37C are all lifted up by the cams. When they are let down by the rotation of the cams, the idler wheels are all spring loaded with a suitable normal force against their respective drive wheels 38A, 38B, 38C, to provide a transversely spaced non-slip, non-skewing, sheet feeding nip set. The transverse spacing of the three sheet feeding nips 37A/38A, 37B/38B, 37C/38C from one another may also be fixed, so as to provide non-skewing sheet feeding of almost any standard width sheet. All three drive wheels 38A, 38B, 38C of all three of the units 32A, 32B, 32C may all be constantly driven at the same speed and in the same direction, by the common drive system 40.

The energy storage apparatus 200 therefore comprises a second spring loaded cam/follower assembly to compressively store the potential energy released by the first assembly of the spring-loaded cam followers 36A, 36B, 36C. One spring assembly starts in the non-deflected position while the other spring assembly starts in the deflected position. As potential energy is transferred through the camshaft 214 to deflect one spring assembly, potential energy is released from the second spring assembly as the deflection is released. Because the potential energy storage apparatus 200 balances the force created by the spring-loaded cam followers 36A, 36B, 36C, the only loads the stepping motor has to handle are friction loads and inertial loads from accelerations.

There are several positive consequences to lowering the total loads on the motor. Using the same motor as was previously used allows for a larger factor of safety. Another feature is that the inertial loads (higher accelerations) could be increased because of the additional load capacity freed up with the elimination of the spring loads. Additionally, a smaller motor can potentially be used along with less electrical energy, resulting in reduced costs.

Figure 6:
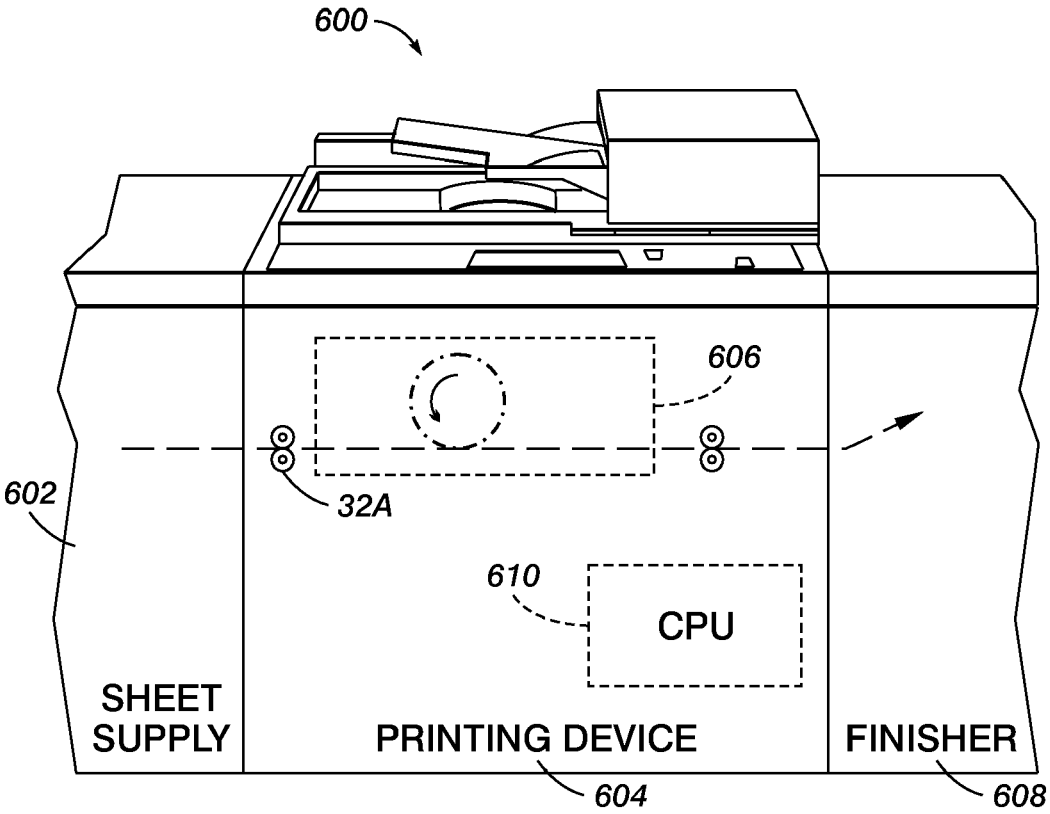
FIG. 6 is a schematic diagram of an apparatus embodiment herein.

As shown in FIG. 6, this disclosure also presents an apparatus embodiment (system 600) that include a media supply 602 that maintains media sheets and a printing device 604 that has a printing engine 606 that places markings on the sheets. The apparatus can also include a finisher 608 (folder, stapler, cutter, etc.). The roller nip based sheet feeding system 32A that uses the structures described above (including the energy storage apparatus 200) provides a sheet path between the media supply 602, the printing engine 606, and the finisher 608. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, the printing device 604 can include some form of processor 610 (central processing unit (CPU)) or other computerized device that can include a computer storage medium. Computerized devices that include chip-based central processing units (CPU's), input/output devices (including graphic user interfaces (GUI), memories, comparators, processors, etc. are well-known and readily available devices produced by manufacturers such as International Business Machines Corporation, Armonk N.Y., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein.

Further, while the structures shown in the accompanying drawings have specific shapes, one ordinarily skilled in the art would understand that the drawings are merely schematic, are not necessarily drawn to scale, and that the shapes chosen therein are selected merely as examples. Therefore, this disclosure is intended to include differently shaped devices than those shown in the accompanying drawings.

Thus, the only loads the stepping motor has to handle are friction loads and inertial loads from accelerations, as shown in graph 108. There are several positive consequences to lowering the total loads on the motor. Using the same motor as was previously used allows for a larger factor of safety and reliability. Another feature is that the inertial loads (higher accelerations) could be increased because of the additional load capacity freed up with the elimination of the spring loads. Additionally, a smaller motor can potentially be used along with less electrical energy, resulting in reduced costs.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet-feeding apparatus comprising:

a sheet path comprising:

at least one camshaft having an axis around which said camshaft rotates;

at least one cam connected to said camshaft;

at least one roller contacting said cam; and at least one biasing member connected to said roller, said biasing member limiting movement of said roller to a constrained linear path orthogonal to and intersecting said axis of said camshaft, and said biasing member storing potential energy as said roller moves away from said axis of said camshaft, while a second biasing member releases energy as a follower moves toward said camshaft, and said biasing member releasing stored potential energy as said roller moves toward said axis of said camshaft, while said second biasing member stores said potential energy.

2. The apparatus according to claim 1, said biasing member comprising one of a spring, a piston, a flexible member, and a compressible member.

3. The apparatus according to claim 1, said biasing member biasing said roller toward said axis of said camshaft.

4. The apparatus according to claim 1, further comprising a stationary frame connected to said biasing member, said biasing member having a first end connected to said roller and a second end connected to said frame.

5. A sheet-feeding apparatus comprising:

a sheet path comprising:

at least one camshaft having an axis around which said camshaft rotates;

at least one cam connected to said camshaft;

at least one roller contacting said cam;

at least one biasing member connected to said roller; and at least one track connected to said roller, said track limiting movement of said roller to a constrained linear path orthogonal to and intersecting said axis of said camshaft, said biasing member storing potential energy as said roller moves away from said axis of said camshaft, while a second biasing member releases energy as a follower moves toward said camshaft, and said biasing member releasing stored potential energy as said roller moves toward said axis of said camshaft, while said second biasing member stores said potential energy.

6. The apparatus according to claim 5, said biasing member comprising one of a spring, a piston, a flexible member, and a compressible member.

7. The apparatus according to claim 5, said biasing member biasing said roller toward said axis of said camshaft.

8. The apparatus according to claim 5, further comprising a stationary frame connected to said biasing member, said biasing member having a first end connected to said roller and a second end connected to said frame.

9. A printing device comprising:

a printing engine; and a sheet path operatively connected to said printing engine and supplying sheets to said printing engine, said sheet path comprising:

at least one camshaft having an axis around which said camshaft rotates;

at least one cam connected to said camshaft;

at least one roller contacting said cam; and at least one biasing member connected to said roller, said biasing member limiting movement of said roller to a constrained linear path orthogonal to and intersecting said axis of said camshaft, and said biasing member storing potential energy as said roller moves away from said axis of said camshaft, while a second biasing member releases energy as a follower moves toward said camshaft, and said biasing member releasing stored potential energy as said roller moves toward said axis of said camshaft, while said second biasing member stores said potential energy.

10. The printing device according to claim 9, said biasing member comprising one of a spring, a piston, a flexible member, and a compressible member.

11. The printing device according to claim 9, said biasing member biasing said roller toward said axis of said camshaft.

12. The printing device according to claim 9, further comprising a stationary frame connected to said biasing member, said biasing member having a first end connected to said roller and a second end connected to said frame.

13. A module installable in a printing apparatus, said module comprising:

at least one drive nip, said drive nip comprising:

at least one camshaft having an axis around which said camshaft rotates;

at least one cam connected to said camshaft;

at least one roller contacting said cam; and at least one biasing member connected to said roller, said biasing member limiting movement of said roller to a linear path orthogonal to and intersecting said axis of said camshaft, and said biasing member storing potential energy as said roller moves away from said axis of said camshaft, while a second biasing member releases energy as a follower moves toward said camshaft, and said biasing member releasing stored potential energy as said roller moves toward said axis of said camshaft, while said second biasing member stores said potential energy.

14. The module according to claim 13, said biasing member comprising one of a spring, a piston, a flexible member, and a compressible member.

15. The module according to claim 13, said biasing member biasing said roller toward said axis of said camshaft.

16. The module according to claim 13, further comprising a stationary frame connected to said biasing member, said biasing member having a first end connected to said roller and a second end connected to said frame.

* * * * *